US006880280B2

(12) United States Patent
Burrous et al.

(10) Patent No.: US 6,880,280 B2
(45) Date of Patent: Apr. 19, 2005

(54) SNAP FRAME ARRANGEMENT

(75) Inventors: Thomas P. Burrous, Andover, MA (US); David E. Pitcher, Cambridge, MA (US)

(73) Assignee: Rose Displays LTD, Salem, MA (US)

( * ) Notice: Subject to any disclaimer, the term of this patent is extended or adjusted under 35 U.S.C. 154(b) by 0 days.

(21) Appl. No.: 10/440,923

(22) Filed: May 19, 2003

(65) Prior Publication Data

US 2004/0068904 A1 Apr. 15, 2004

Related U.S. Application Data

(63) Continuation-in-part of application No. 09/820,069, filed on Mar. 28, 2001, now Pat. No. 6,678,982.

(51) Int. Cl.[7] ..... A47G 1/06
(52) U.S. Cl. ..... 40/793
(58) Field of Search ..... 40/611.01, 611.02, 40/611.03, 611.11, 611.12, 790–793

(56) References Cited

U.S. PATENT DOCUMENTS

| | | | | | |
|---|---|---|---|---|---|
| 4,512,094 | A | * | 4/1985 | Seely | 40/791 |
| 4,512,095 | A | * | 4/1985 | Seely | 40/791 |
| 4,519,152 | A | * | 5/1985 | Seely et al. | 40/791 |
| 4,523,400 | A | * | 6/1985 | Seely | 40/791 |
| 5,042,180 | A | * | 8/1991 | Horiuchi | 40/791 |
| 5,815,971 | A | * | 10/1998 | Rothe et al. | 40/718 |
| 6,601,330 | B1 | * | 8/2003 | Dusink | 40/792 |

* cited by examiner

*Primary Examiner*—Andrew D. Wright
(74) *Attorney, Agent, or Firm*—Don Halgren

(57) ABSTRACT

An extruded snap frame panel arrangement assembly for the biased pinching of a display panel therewithin. The arrangement includes an elongated back frame plate, a front frame plate and a curved snap plate integrally co-extruded with the back plate and front plate, for biasedly pinching the display panel therebetween. An elongated, separately extruded cover plate is slidably attached to the curved snap plate for providing a bias to the pinching of the display panel.

24 Claims, 6 Drawing Sheets

SNAP FRAME ARRANGEMENT

This application is a continuation-in-part of my commonly assigned U.S. patent application Ser. No. 09/820,069, filed Mar. 28, 2001, now U.S. Pat. No. 6,678,982, which is incorporated by reference herein, in its entirety.

BACKGROUND OF THE INVENTION

1. Field of the Invention

This invention relates to extruded components for the manufacture of picture frame assemblies and poster support assemblies.

2. Prior Art

Poster gripping assemblies have been known in the field, for a number of years. One such instance is shown in U.S. Pat. No. 4,519,152 to Seely et. al. which shows a tamper proof poster display arrangement. This display arrangement has an outer cover portion with certain defined angles which make it difficult to open the cover from its base. An "opener tool" is required for that. The cover and the base portions are independently extruded and have a hinge relationship which requires a difficult "slide together" assembly.

U.S. Pat. No. 4,937,959 to Palmer et. al. discloses a gripper extrusion arrangement wherein a front cover portion and a rear panel portion are separately extruded and mated together in another complicated hinge assembly. Inadvertent sliding between the front cover portion and the rear panel portion is prevented by a rather complicated discontinuity formed in the front panel which mates with a slot or the like in the rear panel. This requires further operations and unnecessary manufacturing costs.

U.S. Pat. No. 5,307,575 to Ivansson et. al. shows a frame comer assembly wherein adjacent sides of a frame are held together with a rather complicated bracket arrangement. The cover portions and rear panel portions are individually extruded and are snapped together. Alignment of the ends of these multiple component arrangements lead to inaccurate end mis-aligned comer sections.

U.S. Pat. No. 5,732,496 to Tanaka shows a sign frame with comer arrangements for attaching sides of that frame together. Mitered alignment of the comers is avoided by a comer insert which is somewhat more expensive to manufacture and adds a further step in that procedure.

U.S. Pat. Nos. 4,512,094; 4,512,095 and 4,523,400, all to Seely, disclose a hinged, plastic biased poster frame arrangement. None of these references however teach the use of replaceable covers for providing indicia which may be thus changed by the manufacturer to provide a different appearing product, and which cover also physically applies a biasing force to facilitate and supplement the pinching of a poster in that frame arrangement.

It is an object of the present invention, to provide a poster gripping assembly which overcomes the disadvantages of the prior art.

It is a further object of the present invention to provide a poster gripping assembly which may be utilized in a poster-holding configuration by itself or in a frame construction of rectilinear configuration.

It is a further object of the present invention to provide a poster gripping assembly which simplifies the manufacturing operation over the prior art.

It is another object of the present invention to provide a poster gripping apparatus without a biasing spring arrangement required to permit adjustment of its bias.

It is a further object of the present invention to provide a two part frame assembly which is easily extruded and assembled.

It is a further object of the present invention to provide a frame assembly with a cover portion which permits a simple change in bias pressure against a display panel, decor, color or attention gathering characteristics.

It is yet still a further object of the present invention to provide a poster gripping assembly which may be assembled into a rectilinear frame construction with accuracy and simplicity while minimizing the likelihood of defects as may be associated with the prior art.

BRIEF SUMMARY OF THE INVENTION

The present invention relates to a snap frame arrangement for the biased capture and support of a display panel within that snap frame arrangement. The snap frame arrangement may be arranged so as to show the display panel around its entire periphery, preferably in a quadrilateral configuration.

The snap frame arrangement of the present invention comprises an elongated extrusion which consists in cross-section, of a back frame plate unitarily co-extruded with a front frame plate. The back frame plate is attached and parallel to the front frame plate by a connecting bridge portion co-extruded therewith. The bridge portion is preferably perpendicular to one edge of the back frame plate and also to one edge of the front frame plate.

The back frame plate has an inner distal edge defining an inner side thereof. The back frame plate has a slight curve thereto, directed towards the front frame plate. The front frame plate has an innermost edge with an inner "J" portion extruded therewith. An inner flange is disposed on the inner side of the bridge portion between the back frame plate and the front frame plate. The inner flange is arranged in an opposed relationship with respect to the edge of the inner "J" portion. The inner flange and the inner J portion define a generally T-shaped slot with respect to the front framed plate and the back framed plate, and is utilized to receive a corner bracket.

An outer flange extends perpendicularly with respect to the front frame plate and runs longitudinally therealong. The outer flange is spaced from the bridge portion between the back frame plate and the front frame plate by about one third of its height. The outer flange has a distal portion on which a first side arm is arranged from one side thereof. The first side arm has an angled extension forming an acute angle with respect to the first side arm. A curved outer gripping lip is arranged on the distalmost end of the angle extension. The curved outer gripping lip is arranged for support of a cover plate described hereinbelow. The distal end of the outer flange adjacent the first side arm, has a living hinge co-extruded therewith, and attached to a curved snap plate. The curved snap plate defines, in an edge view, a curvilinear member having a distalmost edge. A second side arm is arranged at an acute angle with respect to the curved snap plate and extruded adjacent the distalmost edge. An angled outer gripping lip is disposed on the distalmost edge of the second side arm. The angled outer gripping lip is disposed at an acute angle with respect to the second side arm. The juncture of the curved snap plate and the second side arm defines a locus of contact between the frame assembly and the display panel being supported thereon. A plurality of gripping teeth are disposed adjacent/on the locus of contact of the curved snap plate to provide a gripping mechanism of the curved snap plate with respect to the planar display panel when the snap frame arrangement is in its closed configuration.

The snap frame arrangement comprises a second component which is slidably attachable with respect to the back frame component thereof. The front panel and biasing cover plate comprises a generally J-shaped extrusion, in cross section, the color plate having a curvilinear portion which connects to a rear arm of the cover plate. The rear arm extends generally rearwardly of the front panel. The rear arm has a distal portion to which a curved gripping finger is arranged and attached thereto. The curved gripping finger has an arcuate curve of about two hundred degrees relative to the rear arm to define a pivotable gripping means. The curved gripping finger with its two hundred degree curve with respect to the rear arm defines a first channel therewithin. A locking guide point is co-extruded on the rear arm on the side towards the distal edge of the curved gripping finger. The locking guide point provides a locking mechanism for the first channel when the front panel or cover plate is attached to the frame portion of the snap frame arrangement. The front panel or cover plate has a second edge defined by an end flange arranged at an acute angle with respect to the backside of the front panel or cover plate.

An opposing flange is also co-extruded with the end flange and is in an opposing relationship with the distalmost edge of that end flange. The opposed flange and the end flange define a second channel between them. The opposing flange also is disposed at an acute angle with respect to the cover plate.

In the snap frame assembly arrangement, the elongated front panel or cover plate extrusion is slid onto the elongated back frame component with the first channel slideably receiving the curved outer gripping lip on the distalmost end of the angle extrusion on the first side arm. The second channel slideably receives the angled outer gripping lip disposed on the second side arm at the distalmost edge of the curved snap plate. The angled outer gripping the lip has a planar face and a heel which are pivotably movable with respect to the opposed flange defining one portion of the second channel. When the curved snap plate is biased inwardly against the back frame plate and any panel display disposed thereadjacent, the front cover panel pushes against the angled outer gripping lip and arcuately moves the curved snap plate towards that back frame plate and the display panel, which may include a backer board. Once the location of the angled outer gripping lip is closer towards the back frame plate that is the line between the curved outer gripping lip and the living hinge, the locus of contact and the gripping teeth are biased against that display panel and backer board. The heel of the angled outer gripping lip and the planar face thereof also at that locus will mate with the inner surface of the second channel for full pressure biased thereagainst.

The invention thus comprises an extruded snap frame panel arrangement assembly for the biased pinching of a display panel therewithin. The assembly comprises an elongated back frame plate, a front frame plate and a curved snap plate integrally co-extruded with the back plate and front plate, for biasedly pinching the display panel therebetween. An elongatted cover plate is slidably attached to the curved snap plate for providing a bias to the pinching of the display panel. The snap plate and the cover plate between them defining three elongated pivot locations, wherein a bias is provided to enable pinching of the display panel against the back frame when the cover plate is moved towards the back frame plate and the three elongated pivot locations are beyond co-planar alignment.

The back frame plate has a curve therein to bias against a display panel pinched by the assembly. The back frame plate and the front frame plate are integrally connected by a bridge member extending transversely therebetween. The curved snap plate is attached to the front frame plate by an elongated living hinge co-extruded therewith. A curved gripping lip is arranged to extend off of a side portion of the front frame plate, and an angled outer gripping lip is arranged on a distalmost edge of the snap plate. The angled outer gripping lip is arranged to move arcuately with respect to the curved outer gripping lip by pivoting about the elongated living hinge. The cover plate has a first edge with an elongated first channel thereon, and the cover plate has a second edge with an elongated second channel thereon. The first channel of the cover plate slides onto the curved gripping lip and the second channel of the cover plate slides onto the angled outer gripping lip. The angled outer gripping lip has a planar face which pivots within the second channel. The angled outer gripping lip has a heel which engages an opposed flange of the second channel to maintain the cover plate and the movable attachment of the cover plate to the snap plate. The first channel has an elongated guide point to maintain the curved outer gripping lip within the first channel on the cover plate. The planar face on the angled outer gripping lip lies flat against the second channel when the snap frame arrangement is in a closed configuration. The elongated curved gripping lip and the elongated angled gripping lip define a first plane, and the elongated living hinge lies outside of the first plane when the snap frame arrangement in a closed configuration.

The invention also includes a method of supporting a display panel in a biased flat orientation. The method includes the steps of providing an elongated forwardly-curved back frame plate and a curved snap plate in an integrally connected configuration; sliding an elongated cover plate onto the curved snap plate; inserting an elongated display panel (includes the backer board) onto a front face of the back frame plate; and pivoting the curved snap plate towards the forwardly-curved back plate about an elongated living hinge arranged therebetween to bias the display panel between the back frame plate and the snap plate. The method also may include biasing the curved back frame plate against the display panel to provide a pinching therebetween and maintain the display panel in a flat condition, rotating a first channel and a second channel of the cover plate about a curved outer gripping lip and an angled gripping lip respectively as the snap plate is pivoted about the living hinge, and biasing the snap plate into a closed pinching configuration against a display panel by biasing the cover plate against the snap plate.

The invention also includes an extruded snap frame panel arrangement assembly for the biased pinching of a display panel therewithin, comprising: an elongated back frame plate, and a curved snap plate integrally co-extruded with the back plate, having a primary hinge of softer material co-extruded therebetween. The primary hinge and the back plate each comprise a different durometer material to permit biased pinching of the display panel between the back frame plate and the snap plate. The extruded snap frame panel arrangement may include an elongated cover plate slidably attached to the curved snap plate for providing a bias to the pinching of the display panel between the frame plate and the snap plate. The back frame plate may have a curve therein to bias against a backside of the display panel pinched by the assembly. An elongated gripping member may be arranged on a distal edge of the curved snap plate. The primary hinge is preferably comprised of a softer, lower durometer material than the material of the back frame plate. The elongated gripping member may comprise co-extruded gripping teeth, co-extruded with the primary hinge and the back frame plate. The gripping teeth may be comprised of the lower durometer material. The primary hinge preferably has an elongated pinch point thereon to provide a locus about which the snap frame may pivot.

The invention may also include a method of manufacturing a snap frame arrangement for securely enclosing the periphery of a display panel, comprising the steps of. extruding an elongated back frame plate of a first durometer material; co-extruding a snap plate of a first durometer material together with the back frame plate also along with an elongated primary hinge co-extruded therebetween, wherein the primary hinge is comprised of a second durometer material which is softer than the first durometer material, the snap plate being biasable towards the back frame plate to bias the display panel therebetween; co-extruding an elongated gripping tooth arrangement on a distal edge of the snap plate, the gripping tooth arrangement is comprised of the second durometer material.

BRIEF DESCRIPTION OF THE DRAWINGS

The objects arid advantages of the present invention will become more apparent, when viewed in conjunction with the following drawings in which.

DESCRIPTION OF THE PREFERRED EMBODIMENTS

Figure 1:
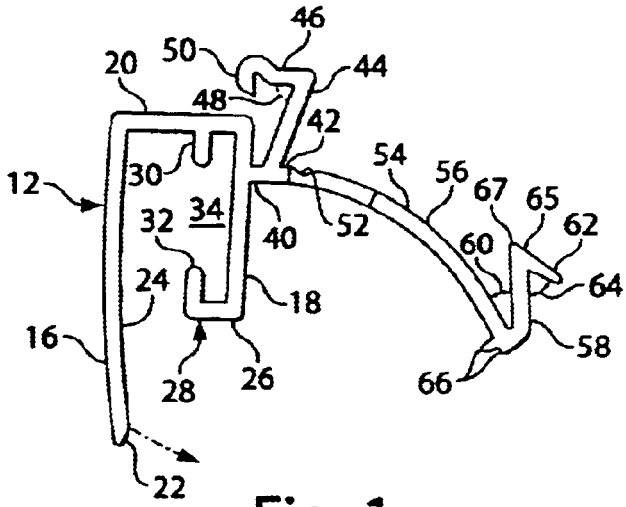
FIG. 1 is an end view of a back frame arrangement for the snap frame assembly of the present invention.

Referring now to the drawings in detail, and particularly to FIG. 1, there is shown an extruded back part 12 of the present invention which comprises a snap frame arrangement 10 for the biased capture and support of a display panel 14 (shown in FIG. 3A, 3B and 4) within that snap frame arrangement 10. The snap frame arrangement 10 may be arranged so as to show the display panel 14 from one edge, or the snap frame arrangement 10 may be arranged around its entire periphery, preferably in a quadrilateral configuration.

Figure 1A:
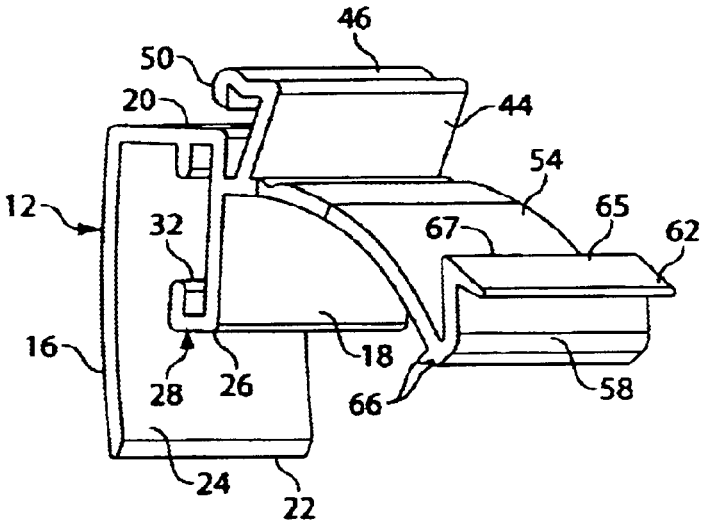
FIG. 1A is a perspective view of the back frame component assembly shown in a perspective orientation.

The snap frame arrangement 10 of the present invention includes a elongated extrusion which consists in cross-section, of a back frame plate 16 unitarily co-extruded with a front frame plate 18, shown in FIGS. 1 and 1A. The back frame plate 16 is attached and parallel to the front frame plate 18 by a connecting bridge portion 20 co-extruded therewith. The bridge portion 20 is preferably perpendicular to one edge of the back frame plate 16 and also to one edge of the front frame plate 18.

The back frame plate 16 has an inner distal edge 22 defining an inner side 24 thereof. The back frame plate 16 has a slight curve thereto, directed towards the front frame plate 18, as may be seen in FIG. 1 to provide a gripping and pressure bias against a display panel 14 and the front component described hereinbelow. The front frame plate 18 has an innermost edge 26 with an inner "J" portion 28 extruded therewith.

An inner flange 30 is disposed on the inner side of the bridge portion 20 between the back frame plate 16 and the front frame plate 18. The inner flange 30 is arranged in an opposed relationship with respect to the distalmost edge 32 of the inner "J" portion 28. The inner flange 30 and the inner "J" portion 28 define a generally "T" shaped slot 34 with respect to the front frame plate 18 and the back frame plate 16, and is utilized to receive a comer bracket (not shown for clarity).

Figure 3A:
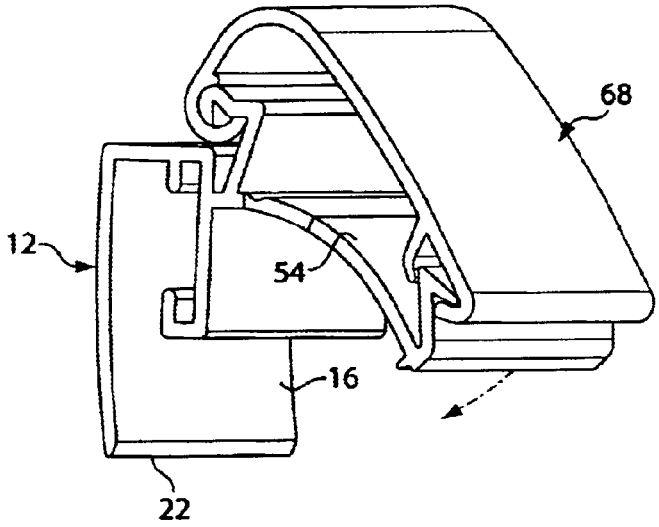
FIG. 3A is a perspective view of the back frame component and the front panel or cover plate.

An outer flange 40 extends perpendicularly with respect to the front frame plate 18 and runs longitudinally therealong, as may be seen FIG. 1, 1A, and 3A. The outer flange 40 is spaced from the bridge portion 20 between the back frame plate 16 and the front frame plate 18 by about one third of the width of the "T" shaped section 34. The outer flange 40 has a distal portion 42 on which a first side arm 44 is arranged from one side thereof. The first side arm 44 has an angled extension 46 forming an acute angle 48 with respect to the first side arm 44.

Figure 3B:
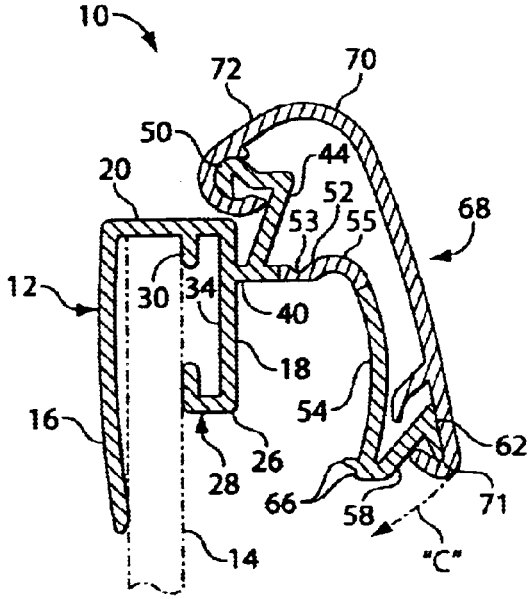
FIG. 3B is a sectional view of the back frame component and the front panel or cover plate in a closing configuration, showing the flexible dual durometer extrusion and the curve conformity of the hinge material during a portion of the closing motion.

A curved outer gripping lip 50 is arranged on the distalmost end of the angled extension 46. The curved outer gripping lip 50, which defines a pivot point, is arranged for support of a cover plate 68 described hereinbelow. The distal end 42 of the outer flange 40 adjacent the first side arm 44, has a primary "living hinge" 52 co-extruded therewith, and is co-extrudedly attached to and between the distal end 42 of the outer flange 40 and a curved snap plate 54. The "living hinge" 52, shown in cross section in FIG. 3B, is also co-extruded with both the back frame 12 and the snap plate 54. The primary hinge 52 has an elongated pinch point 53, shown in FIG. 3B, which functions as the locus of flexure or second pivot point/joint, about which the snap plate 54 pivots. The primary hinge 52, the back frame 12 and the snap plate 54 are all co-extruded simultaneously for minimization of costs and simplicity in subsequent component assembly. The plastic material comprising the primary hinge 52 is a softer plastic of a lower durometer (its softness and/or hardness typically expressed as a number on the "Rockwell" Scale). The primary hinge 52 is able to "bow" or bend somewhat, as indicated in the arcuate section shown by the numeral 55 in FIG. 3B, to accommodate the dimensional compression that the rigid cover plate 68, described hereinbelow, effects as the components (especially snap plate 54 and hinge 52) swing through their respective arcs, upon closure or opening of the snap frame arrangement 10. This construction also eliminates the need for a spring within the assembly, as is common in the prior art, and permits mitered cuts at comers without concern for springs common in the prior art.

The curved snap plate 54 defines, in an edge view of FIG. 1 a curvilinear member having a distalmost edge portion 56. A second side arm 58 is arranged at an acute angle 60 with respect to the curved snap plate 54 and extruded adjacent the distalmost edge portion 56. An angled outer gripping lip 62 is disposed on the distalmost edge of the second side arm 58. The angled outer gripping lip 62 is disposed at an acute angle 64 with respect to the second side arm 58, as shown in FIG. 1. The distal end 71 of the lip 62, receivably engaged in a distal corner 69 of the cover plate 68, comprises a third pivot point for the snap frame arrangement 10. Once the three pivot points/joints are in planar alignment, the primary hinge 52 is at maximum bowing or compression. Once out of planar alignment, the snap plate 54 is either biased toward or away from the frame plate 16, depending upon whether the third pivot point 7lis out and away from planar alignment or "between" planar alignment and in gripping contact with a display panel 14.

Figure 4:
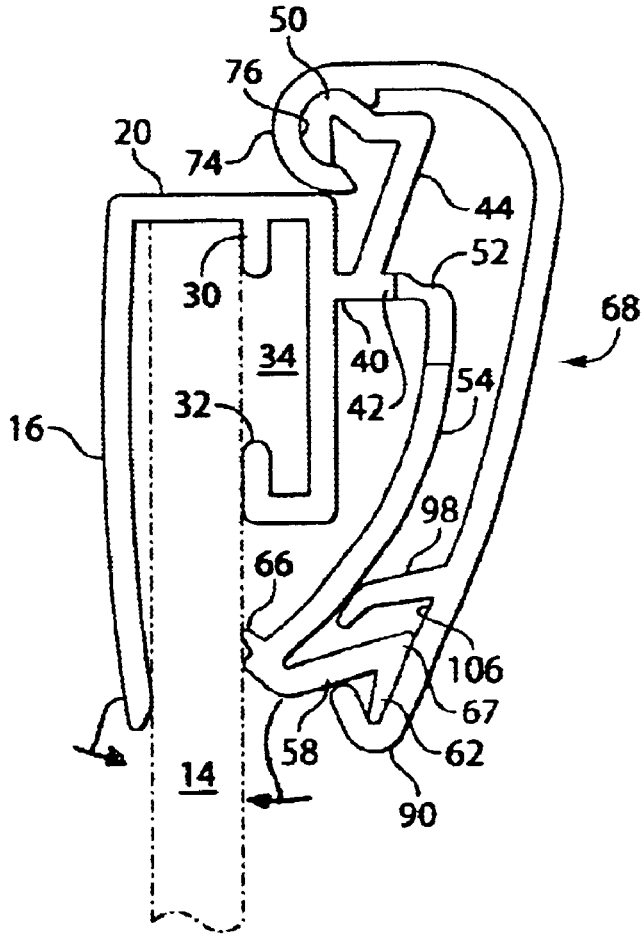
FIG. 4 is an end view of the snap frame arrangement with the components shown biased against a display panel thereadjacent.

The juncture (distalmost edge portion 56) of the curved snap plate 54 and the second side arm 58 defines a locus of contact between the frame assembly 10 and the display panel 14 being supported thereon. A plurality of commonly co-extruded, lower durometer, elongated gripping teeth 66 are disposed adjacent/on the "locus of 'panel-contact' line" of the curved snap plate 54 to provide a gripping mechanism of the curved snap plate 54 with respect to the planar display panel 14 when the snap frame arrangement 10 is in its closed configuration, shown in FIG. 4. The gripping teeth 66 are comprised of a lower durometer material than the material comprising the back frame 12 and the snap plate 54. These "softer" co-extruded, elongated gripping teeth 66 are thus provided with a superior, non-slip grip when they engage a display panel 14, as shown in FIG. 4.

The snap frame arrangement 10 comprises a second component which is an elongated, rigid front panel/biasing cover plate 68 (i.e. metal or plastic) that is slidably attachable onto the back frame 12 component thereof. The front panel and elongated biasing cover plate 68 comprises a generally J-shaped extrusion as shown in cross section in FIG. 2, the cover plate having a curvilinear edge portion 70 which connects to a rear arm 72 of the cover plate 68. The rear arm 72 extends in a generally rearwardly direction from the front panel 68. The rear arm 72 has a distal portion to which a curved gripping finger 74 is co-extrusively arranged and attached thereto. The curved gripping finger 74 has an arcuate curve of about two hundred degrees relative to the rear arm 72. The curved gripping finger 74 with its two hundred degree curve with respect to the rear arm 72 defines a first channel 76. A locking guide point 78 is co-extruded on the rear arm 72 on the side towards the distal edge of the curved gripping finger 74. The locking guide point 78 provides a locking mechanism for the first channel 76 when the front panel or cover plate 68 is attached to the frame portion 16 of the snap frame arrangement 10. The front panel or cover plate 68 has a second edge 90, parallel to the gripping finger 74, and is defined by a short end flange 92 arranged at an acute angle 94 with respect to the backside 96 of the front panel or cover plate 68.

An opposing flange 98 is also co-extruded with the end flange 92 and is in an opposing relationship with the distalmost edge 100 of that short end flange 92. The opposing flange 98 and the end flange 92 define a second channel 102 between them with an inner planar surface 106. The opposing flange 98 also is disposed at an acute angle 104 with respect to the cover plate 68.

In the snap frame assembly arrangement 10, the elongated, rigid front panel or cover plate 68 extrusion is slid onto the elongated back frame component 16 with the first channel 76 slideably receiving the curved outer gripping lip 50 on the distalmost end of the angled extrusion 46 on the first side arm 44. The second channel 102 on the distal edge 90 of the cover plate 68 slideably receives the angled outer gripping lip 62 disposed on the second side arm 58 at the distalmost edge 60 of the curved snap plate 54. The angled outer gripping lip 62 has a planar face 65 and a heel 67 which are pivotably movable with respect to the opposed flange 98 defining one portion of the second channel 102. When the curved snap plate 54 is biased inwardly against the back frame plate 16 and any panel display 14 disposed thereadjacent, the front cover panel 68 moves in a closing direction as indicated by arrow "C" in FIGS. 3 and 3B, and pushes against the angled outer gripping lip 62 and arcuately moves the curved snap plate 54 towards that back frame plate 16 and the display panel 14 (including a backer board), as shown in the closed configuration in FIG. 4.

Once the location of the angled outer gripping lip 62 is closer towards the back frame plate 16, that is the line between the curved outer gripping lip 50 and the living hinge 52, the locus of contact and the gripping teeth 66 are biased against that display panel 14, as shown in FIG. 4. The heel 67 of the angled outer gripping lip 62 and the planar face 65 thereof also at that locus will mate with the inner surface 106 of the second channel 102 for full pressure biased thereagainst. The snap frame arrangement 10 will have moved about the three elongated hinge points, which are the primary hinge 52 pinch point 53, the outer gripping lip 50 and the distal end 71 of the outer gripping lip 62.

Figure 5:
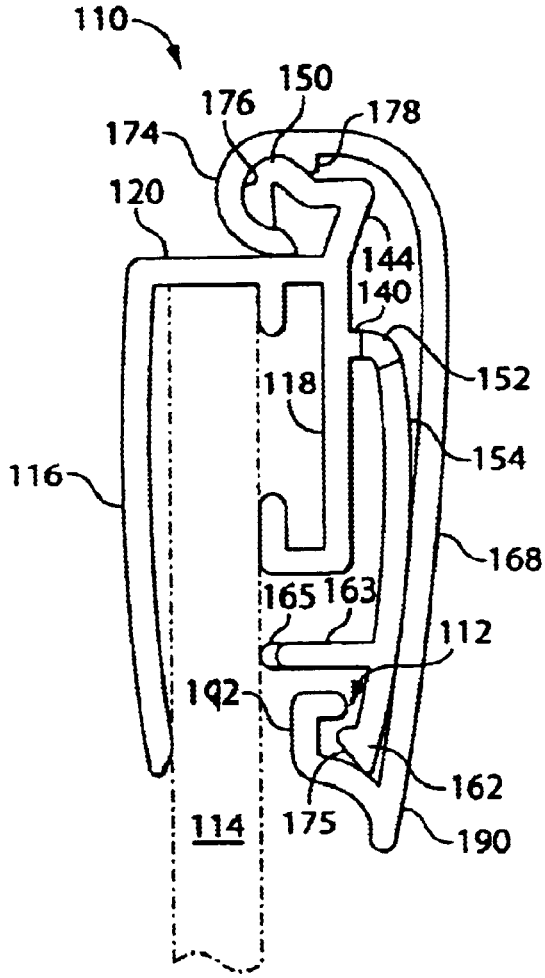
FIG. 5 is a end view of a futher embodiment of the present invention similar to the view shown in FIG. 4.

A further preferred embodiment is shown in FIG. 5 with a snap frame arrangement 110, having a back frame plate 116 which is co-extruded with a front frame plate 118. The back frame plate 116 is attached to the front frame plate 118 by a connecting bridge 120. In this embodiment, a cover plate 168 pivots in a manner similar to the cover plate 68 in the earlier embodiment, having a first channel 176 on a "C" shaped gripping finger 174. A first side arm 144 is unitary with a juncture of the connecting bridge portion 120 and the front frame plate as shown in FIG. 5. A snap plate 154 is attached to the front frame plate 118 by a living hinge 152 which is unitarily extruded with an outer flange 140. The snap plate 154 has a flanged gripping lip 162 which has a planar face 175 which is captured in and pivots in the second channel 112, when the snap plate 154 moves relative to the cover plate 168. An elongated pressure flange 163 extends parallel to the gripping lip 162. A soft strip of co-extruded plastic 165 is disposed on the distalmost edge of the pressure flange 163 for biased engagement with the display panel 114. An elongated "U" shaped end flange 192 is arranged on the distalmost end of the second edge 190 of the cover plate 168, as shown in the end view of FIG. 5. The second channel 112 is created by the "U" shaped end flange 192 and the second edge 190 adjacent the distal edge of the cover plate 168. The end flange 192 on the cover plate 168 lifts the gripping lip 162 away from the backing board/poster 114 when the cover plate 168 is pivoted away therefrom, to permit a change of poster or the like.

Pivoting motion of the cover plate 168 about its first channel 176 in the "C" shaped gripping finger 174 and about the curved outer gripping lip 150, (clockwise as shown in FIG. 5) will effect a biasing of the soft plastic strip 165 on the pressure flange 163 against the backing board/poster 114 once the three pivot points, that is, the first channel 176, the living hinge 152 and the gripping lip 162 in the second channel 112 are out of planar alignment and are pressed towards the back frame 116. A locking point 178 is arranged on the curved outer gripping lip 150 to secure the gripping finger portion 174 to the curved gripping lip 150.

Figure 2:
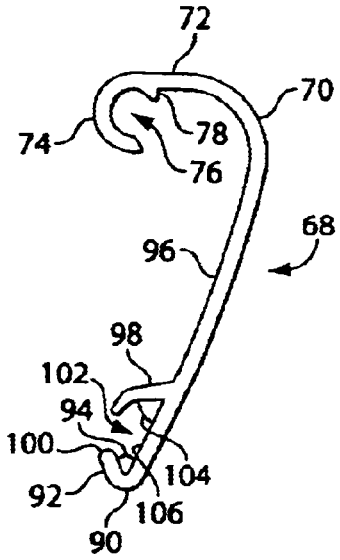
FIG. 2 is an end view of the front panel or cover plate of the snap frame arrangement constructed according to the snap frame assembly of the present invention.
Figure 2A:
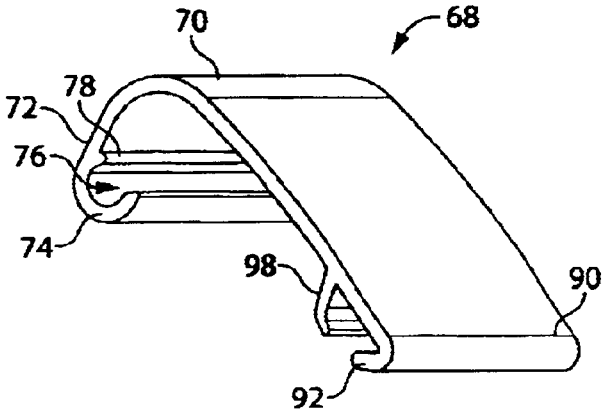
FIG. 2A is a perspective view of the front panel or cover plate shown in FIG. 2.
Figure 6:
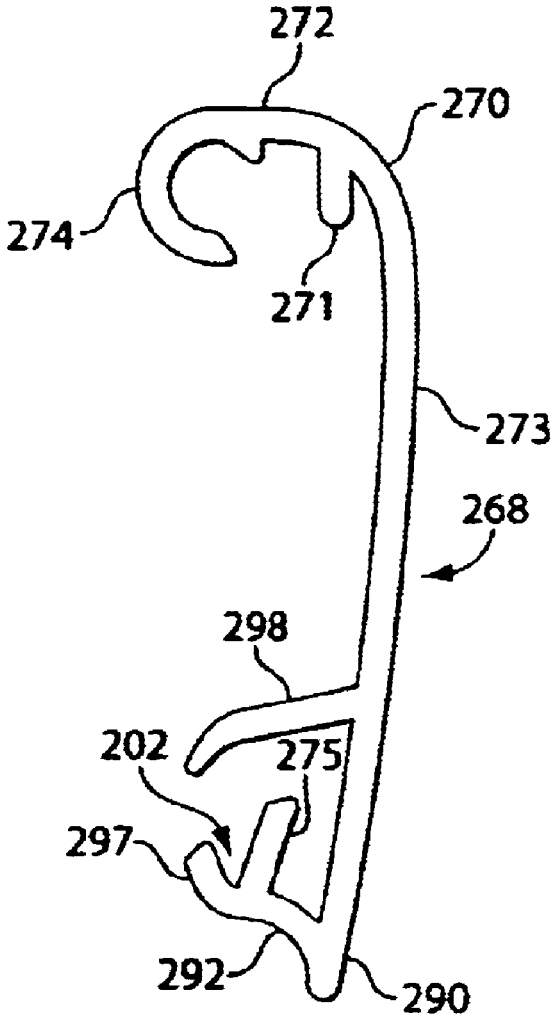
FIG. 6 is an view of a futher preferred embodiment of the cover plate shown in FIG. 2.

A further embodiment of the cover plate 68 initially shown in FIG. 2 is now shown in a "flatter" cover plate 268, as shown in FIG. 6. This flatter cover plate 268 has a curved gripping finger 274 and a first channel 276. The cover plate 268 has a less angled curvilinear edge portion 270 and a rear arm 272. An inner first flange 271 extends generally parallel to the front panel 273 of the cover plate 268. A second edge 290, parallel to the gripping finger 274, is defined by a short end flange 292 and an inner second flange 275 extending from a generally mid point line of the short end flange 292. A distal end 297 of the short end flange 292 defines a second channel 202. An opposing flange 298 is disposed inwardly from the front panel 273.

The second channel 202 is arranged to receive the distalmost edge of the curved snap plate 54, as represented in the aforementioned embodiments. The cover plate 268 represents a flatter plate for any particular desired presentation of coloration, labeling or appearance desired.

Thus in either embodiment of the present invention, a co-extruded frame comprised of plastic material of different hardnesses permits a cover attachment to facilitate a biasing of that frame onto a poster upon three elongated pivot points of that elongated extruded assembly passing from one non-planar alignment orientation, through a planar alignment into a further, opposite, non-planar alignment to permit such biasing thereby.

We claim:

1. An extruded snap frame panel arrangement assembly for the biased pinching of a display panel therewithin, comprising:

an elongated back frame plate, a front frame plate and a curved snap plate integrally co-extruded with said back frame plate and front frame plate, for biasedly pinching said display panel therebetween;

a replaceable cover plate slidably attached to said curved snap plate for providing a bias to said pinching of said display panel.

2. The extruded snap frame panel arrangement as recited in claim 1, wherein said back frame plate has a curve therein to bias against a display panel pinched by said assembly.

3. The extruded snap frame panel arrangement as recited in claim 1, wherein said back frame plate and said front frame plate are integrally connected by a bridge member extending transversely therebetween.

4. The extruded snap frame panel arrangement as recited in claim 1, wherein said curved snap plate is attached to said front frame plate by an elongated living hinge co-extruded therewith.

5. The extruded snap frame panel arrangement as recited in claim 4, wherein a curved gripping lip is arranged to extend off of a side portion of said front frame plate, and an angled outer gripping lip is arranged on a distalmost edge of said curved snap plate.

6. The extruded snap frame panel arrangement as recited in claim 5, wherein said angled outer gripping lip is arranged to move arcuately with respect to said curved outer gripping lip by pivoting about said elongated living hinge.

7. The extruded snap frame panel arrangement as recited in claim 6, wherein said cover plate has a first edge with an elongated first channel thereon, and said cover plate has a second edge with an elongated second channel thereon.

8. The extruded snap frame panel arrangement as recited in claim 7, wherein said first channel of said cover plate slides onto said curved gripping lip and said second channel of said cover plate slides onto said angled outer gripping lip.

9. The extruded snap frame panel arrangement as recited in claim 8, wherein said angled outer gripping lip has a planar face which pivots within said second channel.

10. The extruded snap frame panel arrangement as recited in claim 9, wherein said angled outer gripping lip has a heel which engages an opposed flange of said second channel to maintain said cover plate and the movable attachment of said cover plate to said curved snap plate.

11. The extruded snap frame panel arrangement as recited in claim 10, wherein said first channel has an elongated guide point to maintain said curved outer gripping lip within said first channel on said cover plate.

12. The extruded snap frame panel arrangement as recited in claim 9, wherein said planar face on said angled outer gripping lip lies flat against said second channel when said snap frame arrangement is in a closed configuration.

13. The extruded snap frame panel arrangement as recited in claim 12, wherein said elongated curved gripping lip and said elongated angled gripping lip define a first plane, and said elongated living hinge lies outside of said first plane when said snap frame arrangement in a closed configuration.

14. A method of supporting a display panel in a biased flat orientation comprising:

providing an elongated forwardly-curved back frame plate and a curved snap plate in an integrally connected configuration;

sliding an elongated cover plate onto said curved snap plate;

inserting an elongated display panel onto a front face of said back frame plate;

pivoting said curved snap plate towards said elongated forwardly-curved back frame plate about an elongated primary hinge arranged therebetween to bias said display panel between said back frame plate and said curved snap plate;

biasing said elongated forwardly-curved back frame plate against said display panel to provide a pinching therebetween and maintain said display panel in a flat condition: and rotating a first channel and a second channel of said cover plate about a curved outer gripping lip and an angled gripping lip respectively as said curved snap plate is pivoted about said primary hinge.

15. The method as recited in claim 14, including:

biasing said curved snap plate into a closed pinching configuration against said display panel by biasing said cover plate against said snap plate.

16. An extruded snap frame panel arrangement assembly for the biased pinching of a display panel therewithin, comprising:

an elongated back frame plate, a front frame plate and a curved snap plate integrally co-extruded with said back frame plate and front frame plate, for biasedly pinching said display panel therebetween;

a replaceable cover plate slidably attached to said curved snap plate for providing a bias to said pinching of said display panel; wherein said back frame plate has a curve therein to bias against said display panel pinched by said assembly, and wherein said elongated back frame plate and said front frame plate are integrally connected by a bridge member extending transversely therebetween; said curved snap plate being attached to said front frame plate by an elongated living hinge co-extruded therewith, an curved gripping lip being arranged to extend off of a side portion of said front frame plate, and an angled outer gripping lip is arranged on a distalmost edge of said snap plate, said angled outer gripping lip being arranged to move arcuately with respect to said curved gripping lip by pivoting about said elongated living hinge, said cover plate having a first edge with an elongated first channel thereon, and said cover plate has a second edge with an elongated second channel thereon, said first channel of said cover plate slides onto said curved gripping lip and said second channel of said cover plate slides onto said angled outer gripping lip.

17. An extruded snap frame panel arrangement assembly for the biased pinching of a display panel therewithin, comprising:

an elongated back frame plate, and a curved snap plate integrally co-extruded with said elongated back frame plate, having a primary hinge of softer material co-extruded therebetween, said primary hinge and said elongated back frame plate each comprising a different durometer material to permit biased pinching of said display panel between said elongated back frame plate and said curved snap plate, and a replaceable cover plate slidably attached to said curved snap plate for providing a bias to said pinching of said display panel between said elongated back frame plate and said curved snap plate.

18. The extruded snap frame panel arrangement as recited in claim 17, including:

said replaceable cover plate slidably attached to said curved snap plate having indicia visibly on a front portion thereof for attracting attention to said display panel between said elongated back frame plate and said curved snap plate.

19. The extruded snap frame panel arrangement as recited in claim 17, wherein said elongated back frame plate has a curve therein to bias against a backside of said display panel pinched by said assembly.

20. The extruded snap frame panel arrangement as recited in claim 17, including an elongated gripping member arranged on a distal edge of said curved snap plate.

21. The extruded snap frame panel arrangement as recited in claim 20, wherein said primary hinge is comprised of a softer, lower durometer material than said elongated back frame plate.

22. The extruded snap frame panel arrangement as recited in claim 21, wherein said elongated gripping member comprises co-extruded gripping teeth, co-extruded with said primary hinge and said elongated back frame plate.

23. The extruded snap frame panel arrangement as recited in claim 22, wherein said gripping teeth are comprised of said lower durometer material.

24. The extruded snap frame arrangement as recited in claim 21, wherein said primary hinge has an elongated pinch point thereon to provide a locus about which said snap may pivot.

* * * * *